US006753122B2

(12) United States Patent
Ohmura et al.

(10) Patent No.: US 6,753,122 B2
(45) Date of Patent: Jun. 22, 2004

(54) TONER FOR DEVELOPING STATIC LATENT IMAGE TO FORM COLOR IMAGE

(75) Inventors: Ken Ohmura, Hachioji (JP); Ryuji Kitani, Hachioji (JP); Yasuko Yamauchi, Hachioji (JP); Kaori Soeda, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/014,655

(22) Filed: Dec. 11, 2001

(65) Prior Publication Data

US 2002/0110745 A1 Aug. 15, 2002

(30) Foreign Application Priority Data

Dec. 15, 2000 (JP) ..... 2000-381921

(51) Int. Cl.[7] ..... G03G 9/09

(52) U.S. Cl. ..... 430/107.1; 430/111.4; 430/111.41; 430/137.14; 430/110.3; 430/110.4

(58) Field of Search ..... 430/110.3, 110.4, 430/137.14, 103.1, 111.4, 111.41

(56) References Cited

U.S. PATENT DOCUMENTS 5,604,067 A * 2/1997 Nagai et al. ..... 430/137.19
5,723,252 A * 3/1998 Patel et al. ..... 430/137.14
5,858,601 A * 1/1999 Ong et al. ..... 430/137.14
5,863,696 A * 1/1999 Koyama et al. ..... 430/137.14
6,346,358 B1 * 2/2002 Cheng ..... 430/137.14
2002/0039699 A1 * 4/2002 Nishimori et al. ..... 430/137.14

OTHER PUBLICATIONS

Diamond, Arthur S. (editor) Handbook of Imaging Materials. New York Marcel–Dekker, Inc. (1991) pp. 160–162.*

* cited by examiner

*Primary Examiner*—Christopher Rodee
(74) *Attorney, Agent, or Firm*—Muserlian, Lucas and Mercanti

(57) ABSTRACT

A toner for forming a color image comprises chromatic toners and a black toner is disclosed. Each of the toners is produced by polymerization of a polymerizable monomer in an aqueous medium, the difference of re-dispersion electroconductivity of each of the toners is within the range of from 0.8 to 12 $\mu$s/cm, the number of free colorant particles on the black toner surface is less than 9 per 500 toner particles, and a light absorbance at 500 nm of a black toner dispersion is nor more than 0.08.

5 Claims, 2 Drawing Sheets

TONER FOR DEVELOPING STATIC LATENT IMAGE TO FORM COLOR IMAGE

FIELD OF THE INVENTION

This invention relates to a toner for developing static latent image to form a color image and to an image forming method using the toner.

BACKGROUND OF THE INVENTION

Recently, an image forming method using a static latent image developing method such as an electrophotographic method is mainly used in an image forming apparatus for a high-speed and high-quality image formation.

The image formation process using the static latent image developing method is suitably applicable not only for forming a colored image but for stably attaining an image formation with a high-speed and high-quality for a long period.

However, some problems are raised when the developing method is applied to the color image formation, which are not solved yet even though various investigations have been performed.

Among the problems, the largest is as follows. Carbon black is usually used as a colorant in a black toner. The black toner tends to form fog under a condition with a high temperature and a high humidity since the resistively of the carbon black is lower than that of a colorant for a chromatic toner. Moreover, lowering of the static charged amount of the black toner during standing is large. Consequently, problems of character clogging, excessive increasing of halftone image and varying of gradation caused by excessive development density tend to be occurred when the toner is used for development after a long period of standing.

Besides, in the case of the chromatic toner, the toner amount for developing is reduced under a low temperature and low humidity condition compared with the black toner since the electro-conductivity of the chromatic toner is higher than that of the black toner. As a result of that, the balance of the black image and the chromatic image is lost so to lower the image quality.

In the case of the chromatic toner produced by a crushing method, the distribution of static charge amount is made broad since the distributions of the shape and particle size of such the toner are broad. Consequently, reproducibility of a fine dot and a fine line tends to be made insufficient since the scatter of the toner around the latent image.

Relating to such the problems, some countermeasures have been disclosed which have been based in the notice on the re-dispersion electro-conductivity, called also as a dispersion electro-conductivity. For example, Japanese Patent Publication Open to Public Inspection, hereinafter referred to as JP O.P.I., No. 7-319205 describes a toner having a re-dispersion electro-conductivity of within the range of from 1 to 100 $\mu$S/cm. JP O.P.I. No. 2000-172007 describes a toner having a re-dispersion electro-conductivity of not more than 20 $\mu$S/cm and a specified particle size distribution.

However, the above-mentioned problems have not been solved by such techniques and they still remain a problem in the art.

SUMMARY OF THE INVENTION

The object of the invention is to provide a toner for developing a static latent image to form a color image and an image forming method by which an image constantly showing no fogging, a high reproducibility of fine dot and fine line and a good color balance can be obtained.

It has been found by the inventors that there is a limit on the effect of the control of the re-dispersion electro-conductivity of the toner and a suitable full color image can be obtained by making a good balance between the static charge property of the black toner and the chromatic toner by controlling the re-dispersion electro-conductivity of the toners, the amount of free colorant on the black toner particle surface and the surface condition of the black toner.

1. A toner for developing static latent image to form a color image by combining chromatic toners of yellow, magenta and cyan and a black toner, wherein each of the toners is a toner produced by polymerization of a polymerizable monomer in an aqueous medium, the difference of the re-dispersion electro-conductivity of each of the toners is within the range of from 0.8 to 12 $\mu$S/cm, the number of free colorant particles on the black toner surface is less than 9 per 500 toner particles, and a light absorbance at 500 nm of a black toner dispersion is not more than 0.08.
2. The toner for developing a static latent image, wherein $\rho y > \rho bk$, $\rho m > \rho bk$ and $\rho c > \rho bk$, when the $\rho y$ is the re-dispersion electro-conductivity of the yellow toner, the $\rho m$ is the re-dispersion electro-conductivity of the magenta toner, the $\rho c$ is the re-dispersion electro-conductivity of the cyan toner and the $\rho bk$ is the re-dispersion electro-conductivity of the black toner.
3. The toner for developing a static latent image, wherein the each of the toners is a toner produced by the process for polymerizing the polymerizable monomer in the aqueous medium, salting/coagulating and washing.
4. The toner for developing a static latent image, wherein each of the chromatic toners has an average diameter of is from 3 to 8 $\mu$m and a ratio of toner particles having a shape coefficient of from 1.2 to 1.6 of not less than 65%.
5. The toner for developing a static latent image, wherein each of the chromatic toners has the average diameter of from 3 to 8 $\mu$m and a ratio of particles having no corner of not less than 50%.
6. The toner for developing a static latent image, wherein the sum M of a relative frequency m1 of toner particles included in the highest frequency class and a relative frequency m2 of toner particles included in the next frequency class is not less than 70% in a histogram showing the particle size distribution based on the number of the particles in which natural logarithm lnD of the particle diameter of each of the toners D $\mu$m is taken on the horizontal axis and the axis is divided every 0.23.
7. An image forming method for forming a color image by a combination of yellow, magenta and cyan chromatic toners and a black toner, wherein each of the toners is a toner produced by polymerization of a polymerizable monomer in an aqueous medium, the difference of the re-dispersion electro-conductivity of each of the toner is within the range of from 0.8 to 12 $\mu$S/cm, a number of free colorant particle on the black toner surface is less than 9 per 500 toner particles, and a light absorbance at 500 nm of a black toner dispersion is nor more than 0.08.
8. The image forming method for forming a color image, wherein $\rho y > \rho bk$, $\rho m > \rho bk$ and $\rho c > \rho bk$, when the $\rho y$ is the re-dispersion electro-conductivity of the yellow toner, the ρm is the re-dispersion electro-conductivity of the magenta toner, the pa is the re-dispersion electro-conductivity of the cyan toner and the ρbk is the re-dispersion electro-conductivity of the black toner.

DETAILED DESCRIPTION OF THE INVENTION

Figure 1:
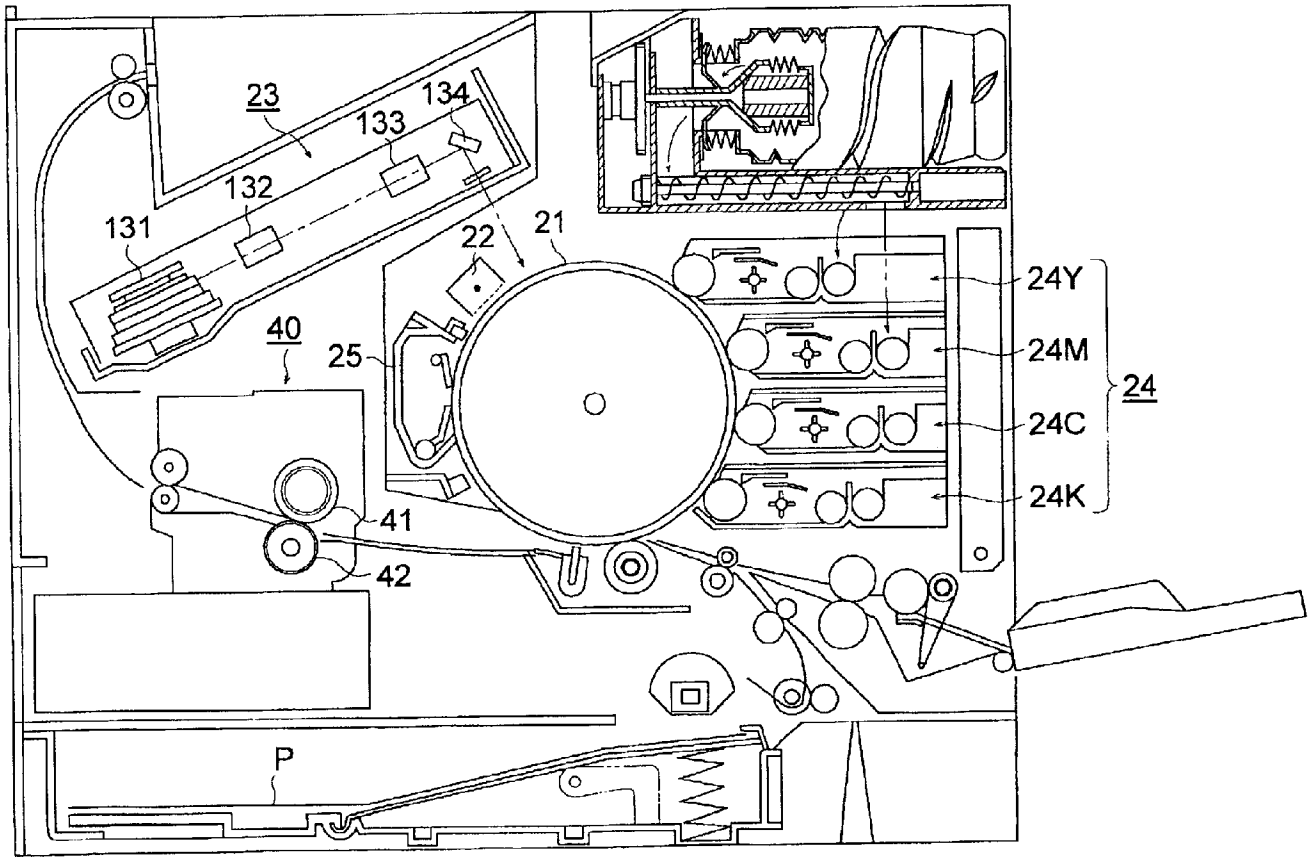
FIG. 1 shows a schematic view of an image forming apparatus to which the color toner of the invention is applicable.

The re-dispersion electro-conductivity of toner is an electro-conductivity of a dispersion prepared by redispersing in water a toner which is produced by polymerizing a polymerizable monomer in an aqueous medium, washing to remove a salt such as a surfactant remained on the toner surface and drying the toner.

Namely, the re-dispersion electro-conductivity is a electro-conductivity of a dispersion prepared by redispersing in water a toner produced by polymerization. The electro-conductivity of the toner depends on not only on the kind of the colorant contained in the toner but the dispersibility of the colorant in the toner and the influence of the salt such as the surfactant remained on the surface of the toner particle.

Some times, colorant-containing particle polymerized in the aqueous medium and added with an exterior additive such as silica is called as "a toner", and the particles before addition of the exterior additive is called as "a colored particle". However, in the description of the invention, the particle before addition of the exterior additive is called as "a toner", except when the specific classification is necessary.

<Determination of Re-Dispersion Electro-Conductivity of Toner>

The re-dispersion electro-conductivity of the toner is practically performed as follows:

One part by weight of the toner is added to 20 parts by weight of ion-exchanged water or distillated water each having an electro-conductivity of from 1.0 to 1.5 and dispersed by ultrasonic wave for 10 minutes at 25° C. and for approximately 10 minutes at 40° C. The electro-conductivity of thus obtained aqueous extract liquid is measured by an electric conductive meter, Conductive Meter CM-11P manufactured by Toa Denpa Kogyo Co., Ltd.

The electro-conductivity of each of the toners is preferably from 2 to 40 μS, more preferably from 3 to 15 μS, for stabilizing the charging property.

In the invention, each color toners are used each of which has a difference of the dispersion electro-conductivity of from 0.8 to 12 μmS/cm. The difference is preferably from 2 to 10 μmS/cm, more preferably from 4 to 8 μmS/cm. When the difference of the re-dispersion electro-conductivity is larger than 12 μmS/cm, the color difference and the color balance are deteriorated under a condition with a high temperature and a high humidity. When the difference of the re-dispersion electro-conductivity is smaller than 0.8 μmS/cm, a difference between the adhering amount by development of the black toner containing a electro conductive or semi-conductive colorant and that of each of the chromatic toners containing an electric non-conductive colorant is made depending on changing of the atmosphere condition, particularly changing of the humidity. Consequently, the blackening effect of the black toner is lowered so as to lower the image quality. In the invention, the difference of re-dispersion electro-conductivity is a difference between the re-dispersion electro-conductivity of each of the chromatic toner and that of the black toner. In concrete, the difference is the difference between the re-dispersion electro-conductivity of the yellow toner and that of the black toner, the magenta toner and the black toner and the cyan toner and the black toner. In the invention, it is preferable to use the toners having the relations of ρy>ρbk, ρm>ρbk and ρc>ρbk, when the ρy is the re-dispersion electro-conductivity of the yellow toner, the ρm is the re-dispersion electro-conductivity of the magenta toner, the ρc is the re-dispersion electro-conductivity of the cyan toner and the ρbk is the re-dispersion electro-conductivity of the black toner. When the toners have the above-mentioned relation, the difference of the amounts of each toner adhered by the development according to the changing of the surrounding condition is reduced and the blackening effect of the black toner can be stably obtained.

(Light Absorbance at 500 nm of Re-Dispersion Liquid of the Black Toner)

The light absorbance at 500 nm of re-dispersion liquid of the black toner is an absorbance at 500 nm of an aqueous extract liquid measured by a spectrophotometer. The aqueous extract liquid is prepared in the same manner as in measurement of the electro-conductivity. One part by weight of the toner is added to 20 parts by weight of ion-exchanged water or distillated water each having a electro-conductivity of from 1.0 to 1.5 and dispersed by ultrasonic wave for 10 minutes at 25° C. and for approximately 10 minutes at 40° C. The reference of the light absorbance measurement is the ion exchanges water or the distillated water used for the extraction.

The absorbance of the re-dispersion liquid of not more than 0.08 is suitable. More preferable absorbance is not more than 0.01.

(Number of Free Colorant Particles on the Surface of 500 Particles of the Black Toner)

The surface of the toner particles is observed by a field effect type scanning electron microscope JSM6400F, manufactured by Nihon Denshi Co., Ltd., to count the number of the carbon black particle on the surface of the toner particles. The observation is performed with respect to 500 toner particles.

It is found that the dependency of the charging amount on the surrounding conditions can be made to the smallest by reducing the presence of the black colorant having a high electro-conductivity. Practically, the number of the black colorant particle is preferably less than 9, more preferable not more than 7 and particularly preferably from 0 to 3, per 500 particles of the toner.

The re-dispersion electro-conductivity of the toner and the amount of the free colorant on the surface of the black toner particle can be controlled according to the polymerization condition, the salting-out/association condition, kind of the surfactant existing in the polymerization or association liquid, the concentration of the surfactant, the washing condition and the drying condition. Among them, the easiest way is repeating a process in which once dried colored particles are redispersed in ion exchanged water and dried. Thus suitable toner particles can be produced.

Embodiments of the Invention

Various constituting elements and the image forming method are described below.

(Producing Method of Toner)

The toner usable in the invention can be produced by preparing resin particles by a suspension polymerization method, an emulsion polymerization method or a mini-emulsion polymerization method and salting out/coagulating thus obtained resin particles.

When the toner is produced by the suspension polymerization method, the production is performed by the following procedure. Various raw materials such as a colorant, a mold releasing agent according to necessity, a charge controlling agent and a polymerization initiator are added into a polymerizable monomer and dispersed or dissolved by a homogenizer, a sand mill, a sand grinder or a ultrasonic dispersing apparatus. The polymerizable monomer in which the raw materials are dissolved or dispersed is dispersed into a form of oil drops having a suitable size as toner particle by a homo-mixer or a homogenizer in an aqueous medium containing a dispersion stabilizing agent. Then the dispersion is moved into a reaction vessel having a stirring device with double stirring blades, and the polymerization reaction is progressed by heating. After finish of the reaction, the dispersion stabilizing agent is removed from the polymer particles and the polymer particles are filtered, washed and dried to prepare a toner. In the invention, the "aqueous medium" is a medium containing at least 50% by weight of water.

The toner according to the invention can be also obtained by salting-off/coagulating resin particles prepared by the emulsion polymerization or the mini-emulsion polymerization.

For example, the methods described in JP O.P.I. Nos. 5-265252, 6-329947 and 9-15904 are applicable. The toner can be produced by a method by which dispersed particles of constituting material such as resin particles and colorant or fine particles constituted by resin and colorant are associated several by several. Such the method is realized particularly by the following procedure: the particles are dispersed in water and the particles are salted-out by addition of a coagulation agent in an amount of larger than the critical coagulation concentration. At the same time, the particles are gradually grown by melt-adhesion of the particles by heating at a temperature higher than the glass transition point of the produced polymer. The particle growing is stopped by addition of a large amount of water when the particle size is reached at the prescribed diameter. Then the surface of the particle is made smooth by heating and stirring to control the shape of the particles. The particles containing water in a fluid state are dried by heating. Thus the toner can be produced. In the foregoing method, a water-miscible solvent may be added together with the coagulation agent.

An example of the producing method of the toner according to the invention is described below.

The production process comprises, for example, the following processes:

1. A multi-step polymerizing process (I) to obtain a composite resin particles which comprise a releasing agent in a portion other than the outermost layer (core or inter layer)
2. A salting-out/coagulation process (II) to produce a toner particle by salting-out/coagulating the compound resin particles and colorant particles
3. Filtering and washing processes to filter the toner particles from the toner particle dispersion and to remove a unnecessary substance such as the surfactant from the toner particles
4. A drying process to dry the washed toner particles
5. A process to add an exterior additive to the toner particles Each of the processes is described below.

(Multi-Step Polymerization Process (I))

The multi-step polymerization process (I) is a process for preparing the composite resin particle by forming the covering layer (n+1) of the polymer of a monomer (n+1) on the surface of the resin particle (n) by the multi-step polymerization method.

It is preferred from the viewpoint of the stability and the anti-crush strength of the obtained toner to apply the multi-step polymerization including three or more polymerization steps.

The two- and tree-step polymerization methods are described below.

(Two-Step Polymerization Method)

The two-step polymerization method is a method for producing the composite resin particle comprised of the central portion (core) containing the releasing agent and/or the crystalline polyester comprising the high molecular weight resin and an outer layer (shell) comprising the low molecular weight resin.

In concrete, a monomer liquid is prepared by dissolving the releasing agent and/or the crystalline polyester in a monomer H, the monomer liquid is dispersed in an aqueous medium (an aqueous solution of a surfactant) in a form of oil drop, and the system is subjected to a polymerization treatment (the first polymerization step) to prepare a suspension of a high molecular weight resin particles H each containing the releasing agent and/or the crystalline polyester.

Next, a polymerization initiator and a monomer L to form the low molecular weight resin is added to the suspension of the resin articles H, and the monomer L is subjected to a polymerization treatment (the second polymerization step) to form a covering layer L composed of the low molecular weight resin (a polymer of the monomer L) onto the resin particle H.

(Three-Step Polymerization Method)

The three-step polymerization method is a method for producing the composite resin particle comprised of the central portion (core) comprising the high molecular weight resin, the inter layer containing the releasing agent and/or the crystalline polyester and the outer layer (shell) comprising the low molecular weight resin.

In concrete, a suspension of the resin particles H prepared by the polymerization treatment (the first polymerization step) according to a usual procedure is added to an aqueous medium (an aqueous solution of a surfactant) and a monomer liquid prepared by dissolving the releasing agent and/or the crystalline polyester in a monomer M is dispersed in the aqueous medium. The aqueous dispersion system is subjected to a polymerization treatment (the second polymerization step) to form a covering layer M (inter layer) comprising a resin (a polymer of the monomer M) containing the releasing agent and/or the crystalline polyester onto the surface of the resin particle H (core particle). Thus a suspension of combined resin (high molecular weight resin-low molecular weight resin) particles is prepared.

Next, a polymerization initiator and a monomer L to form the low molecular weight resin is added to the suspension of the combined resin articles, and the monomer L is subjected to a polymerization treatment (the third polymerization step) to form a covering layer L composed of the low molecular weight resin (a polymer of the monomer L) onto the composite resin particle.

In the three-step polymerization method, the releasing agent and/or the crystalline polyester can be finely and uniformly dispersed by applying a procedure, at the time of forming the covering layer M on the resin particle H, that a suspension of the resin particles H is added to an aqueous medium (an aqueous solution of a surfactant) and a monomer liquid prepared by dissolving the releasing agent and/or the crystalline polyester in a monomer M is dispersed in the aqueous medium, and thus obtained system is subjected to the polymerization treatment (the second polymerization step).

Either the step of addition of the suspension of the resin particle H or the step of dispersion of the monomer liquid into the form of oil drops may be performed first or both of the steps may be performed simultaneously.

The resin particles containing a releasing agent can be obtained as latex particles by dissolving the releasing agent in a monomer to obtain the binding resin, dispersing the monomer solution in an aqueous dispersant, and then processing polymerization.

The water based medium means one in which at least 50 percent, by weight of water, is incorporated.

Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

Methods are preferred in which dispersion is carried out employing mechanical force. Said monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

In the usual emulsion polymerization method, the releasing agent and/or the crystalline polyester dissolved in oil phase tends to desorb. On the other hand sufficient amount of the releasing agent and/or the crystalline polyester can be incorporated in a resin particle or covered layer by the mini-emulsion method in which oil droplets are formed mechanically.

Herein, homogenizers to conduct oil droplet dispersion, employing mechanical forces, are not particularly limited, and include, for example, "CLEARMIX", ultrasonic homogenizers, mechanical homogenizers, and Manton-Gaulin homogenizers and pressure type homogenizers. Further, the diameter of dispersed particles is 10 to 1,000 nm, and is preferably 30 to 300 nm.

Emulsion polymerization, suspension polymerization seed emulsion etc. may be employed as the polymerization method to form resin particles or covered layer containing the releasing agent and/or the crystalline polyester. These polymerization methods are also applied to forming resin particles or covered layer which does not contain the releasing agent and/or the crystalline polyester.

The particle diameter of composite particles obtained by the process (1) is preferably from 10 to 1,000 nm in terms of weight average diameter determined employing an electrophoresis light scattering photometer "ELS-800" (produced by Ohtsuka Denshi Co.).

Glass transition temperature (Tg) of the composite resin particles is preferably from 48 to 74° C., and more preferably from 52 to 64° C.

The Softening point of the composite resin particles is preferably from 95 to 140° C.

<Salting-Out/Fusion Process (II)>

Salting-out/fusion process (II) is a process to obtain particles having undefined shape (unsphered shape) in which the composite resin particles obtained by the process (I) and colorant particles are aggregated. All processes of salting-out, aggregation and fusion occur simultaneously in the preferable embodiment.

Particles of additives incorporated within toner particles such as a charge control agent (particles having average diameter from 10 to 1,000 nm) may be added as well as the composite resin particles and the colorant particles in the salting-out/fusion process (II). Surface of the colorant particles may be modified by a surface modifier.

The colorant particles are subjected to salting out/fusion process in a state that they are dispersed in water based medium. The water based medium to disperse the colorant particles includes an aqueous solution dissolving a surfactant in concentration not less than critical micelle concentration (CMC).

Examples of the surfactant include those employed in the multi-step polymerization process.

Homogenizers employed in the dispersion of the colorant particles are not particularly limited, and include, for example, "CLEARMIX", ultrasonic homogenizers, mechanical homogenizers, and Manton-Gaulin homogenizers and pressure type homogenizers such as a pressure homogenizer, medium type homogenizers such as a Getzman mill and a diamond fine mill.

In order to simultaneously carry out salting-out and fusion, it is required that salting agent (coagulant) is added to the dispersion of composite particles and colorant particles in an amount not less than critical micelle concentration and they are heated to a temperature of the glass transition temperature (Tg) or higher of the resin constituting composite particles.

Suitable temperature for salting out/fusion is preferably from (Tg plus 10° C.) to (Tg plus 50° C.), and more preferably from (Tg plus 15° C.) to (Tg plus 40° C.).

An organic solvent which is dissolved in water infinitely may be added in order to conduct the salting out/fusion effectively.

(Filtration and Washing Process) In said filtration and washing process, filtration is carried out in which said toner particles are collected from the toner particle dispersion, and washing is also carried out in which additives such as surface active agents, salting-out agents, and the like, are removed from the collected toner particles (a cake-like aggregate).

Herein, filtering methods are not particularly limited, and include a centrifugal separation method, a vacuum filtration method which is carried out employing a glass filter and the like, a filtration method which is carried out employing a filter press, and the like.

(Drying Process)

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

The moisture content of dried toners is preferably not more than 5 percent by weight, and is more preferably not more than 2 percent by weight.

Further, when dried toner particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

The toner according to the invention is preferably produced by the following procedure, in which the compound resin particle is formed in the presence of no colorant, a dispersion of the colorant particles is added to the dispersion of the compound resin particles and the compound resin particles and the colorant particles are salted-out and coagulated.

In the foregoing procedure, the polymerization reaction is not inhibited since the preparation of the compound resin particle is performed in the system without colorant. Consequently, the anti-offset property is not deteriorated and contamination of the apparatus and the image caused by the accumulation of the toner is not occurred.

Moreover, the monomer or the oligomer is not remained in the toner particle since the polymerization reaction for forming the compound resin particle is completely performed. Consequently, any offensive odor is not occurred in the fixing process by heating in the image forming method using such the toner.

The surface property of thus produced toner particle is uniform and the charging amount distribution of the toner is sharp. Accordingly, an image with a high sharpness can be formed for a long period. The anti-offset and anti-winding properties can be improved and an image with suitable glossiness can be formed while a suitable adhesiveness or a high fixing strength with the recording material or recording paper or image support in the image forming method including a fixing process by contact heating by the use of such the toner which is uniform in the composition, molecular weight and the surface property of the each particles.

Each of the constituting materials used in the toner producing process is described in detail below.

(Polymerizable Monomer)

A hydrophobic monomer is essentially used as the polymerizable monomer for producing the resin or binder used in the invention and a cross-linkable monomer is used according to necessity. As is described below, it is preferable to contain at least one kind of a monomer having an acidic polar group and a monomer having a basic polar group.

As the hydrophobic monomer of the monomer composition, a known monomer can be used without any limitation. One or more kinds of the monomer may be used for satisfying required properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

Listed as halogenated olefin based monomers are vinyl chloride, vinylidene chloride, vinyl bromide, and the like.

(2) Crosslinking Agents

In order to improve the desired properties of toner, added as crosslinking agents may be radical polymerizable crosslinking agents. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Monomer having an Acidic Polar Group

As the monomer having an acidic polar group, (a) an α, β-ethylenically unsaturated compound containing a carboxylic acid group (—COOH) and (b) an α, β-ethylenically unsaturated compound containing a sulfonic acid group (—SO3H) can be cited.

Examples of said α, β-ethylenically unsaturated compound containing the carboxylic acid group (—COOH) of (a) include acrylic acid, methacrylic acid, fumaric acid, maleic acid, itaconic acid, cinnamic acid, maleic acid monobutyl ester, maleic acid mono-octyl ester and their sodium salts, zinc salts, etc.

Examples of said α, β-ethylenically unsaturated compound containing the sulfonic acid group (—SO3H) of (b) include sulfonated styrene and its Na salt, allylsulfo succinic acid, allylsulfo succinic acid octyl ester and their sodium salts.

(4) Monomer having a Basic Polar Group

As the monomer having a basic polar group, can be cited (i) (meth)acrylic acid ester obtained by reacting (meth) acrylic acid with an aliphatic alcohol, which has 1 to 12 carbon atoms, preferably 2 to 8 carbon atoms, specifically preferably 2 carbon atoms, and which also has an amino group or a quaternary ammonium group, (ii) (meth)acrylic acid amide or (meth)acrylic acid amide having mono-alkyl group or di-alkyl group, having 1 to 18 carbon atoms, substituted on its N atom, (iii) vinyl compound substituted with a heterocyclic group having at least a nitrogen atom in said heterocyclic group, (iv) N,N-di-allyl-alkylamine or its quarternary salt. Of these, (meth)acrylic acid ester obtained by reacting (meth)acrylic acid with the aliphatic alcohol having the amino group or the quaternary ammonium group is preferred.

Examples of (meth)acrylic acid ester obtained by reacting (meth)acrylic acid with the aliphatic alcohol having the amino group or the quarternary ammonium group of (i) include dimethylaminoethylacrylate, dimethylaminoethylmethacrylate, diethylaminoethylacrylate, diethylaminoethylmethacrylate, quarternary ammonium salts of the above mentioned four compounds, 3-dimethylaminophenylacrylate and 2-hydroxy-3-methacryloxypropyl trimethylammonium salt, etc.

Examples of (meth)acrylic acid amide or (meth)acrylic acid amide having mono-alkyl group or di-alkyl group substituted on its N atom of (ii) include acrylamide, N-butylacrylamide, N,N-dibutylacrylamide, piperidylacrylamide, methacrylamide, N-butylmethacrlamide, N,N-dimethylacrylamide, N-octadecylacrylamide, etc.

Examples of vinyl compound substituted with a heterocyclic group having at least a nitrogen atom in said heterocyclic group of (iii) include vinylpyridine, vinylpyrrolidone, vinyl-N-methylpyridinium chloride, vinyl-N-ethylpyridinium chloride, etc.

Examples of N,N-di-allyl-alkylamine or its quarternary salt of (iv) include N,N-di-allyl-methylammonium chloride, N,N-di-allyl-ethylammonium chloride, etc.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator For example, the temperature range of 50 to 80° C. is employed. However, by employing a combination of polymerization initiators such as hydrogen peroxide-reducing agent (ascorbic acid and the like), which is capable of initiating the polymerization at room temperature, it is possible to carry out polymerization at at least room temperature.

(Chain Transfer Agents)

For the purpose of regulating the molecular weight of resin particles, it is possible to employ commonly used chain transfer agents.

The chain transfer agents, for example, employed are mercaptans such as octylmercaptan, dodecylmercaptan, tert-dodecylmercaptan, and the like. The compound having mercaptan are preferably employed to give advantageous toner having such characteristics as reduced smell at the time of thermal fixing, sharp molecular weight distribution, good preservavability, fixing strength, anti-off-set and so on. The actual compounds preferably employed include ethyl thioglycolate, propyl thioglycolate, butyl thioglycolate, t-butyl thioglycolate, ethylhexyl thioglycolate, octyl thioglycolate, decyl thioglycolate, dodecyl thioglycolate, an ethyleneglycol compound having mercapt group, a neopentyl glycol compound having mercapt group, and a pentaerythritol compound having mercapt group. Among them n-octyl-3-mercaptopropionic acid ester is preferable in view of minimizing smell at the time of thermal fixing.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline -2,2,5,5-tetramethyl-triphenylmethane -4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

Further, it is possible to employ nonionic surface active agents. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

The surface active agent is employed mainly as an emulsifier, and may be used for other purpose in the other process.

(Molecular Weight Distribution of Resin Particles and Toner)

Resins used in the toner has a peak or a shoulder within the ranges of preferably from 100,000 to 1,000,000 and from 1,000 to 50,000, and more preferably in the ranges from 120,000 to 500,000, and from 25,000 to 150,000 in the molecular weight distribution The resin particles preferably comprises "a high molecular weight resin" having a peak or a shoulder within the range of from 100,000 to 1,000,000, and "a low molecular weight resin" having a peak or a shoulder within the range of from 1,000 to 50,000, and more preferably "a middle molecular weight resin" having a peak or a shoulder within the range of from 15,000 to 100,000, in the molecular weight distribution.

Molecular weight of the resin composing toner is preferably measured by gel permeation chromatography (GPC) employing tetrahydrofuran (THF)

Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 μm, the filtrate is injected in a GPC.

Measurement conditions of GPC are described below. A column is stabilized at 40° C., and THF is flowed at a rate of 1 cc per minute. Then measurement is carried out by injecting approximately 100 μl of said sample at a concentration of 1 mg/cc. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G300OH, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

(Coagulants)

The coagulants employed in the present invention are preferably selected from metallic salts.

Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc.

Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application. Generally, the critical coagulation concentration (coagulation value or coagulation point) of divalent metallic salts is less than that of monovalent metallic salts. Furthermore, the critical coagulation concentration of trivalent metallic salts is lowered.

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the ζ potential of the dispersion, and in addition the critical coagulation concentration may be obtained as the salt concentration which initiates a variation in the ζ potential.

The polymer particles dispersion liquid is processed by employing metal salt so as to have density not less than critical coagulation density. In this instance the metal salt is added directly or in a form of aqueous solution optionally, which is determined according to the purpose. In case that it is added in an aqueous solution the metal salt must satisfy the critical coagulation density including the water as the solvent of the metal salt.

The concentration of coagulant may be not less than the critical coagulation concentration. However, the amount of the added coagulant is preferably at least 1.2 times of the critical coagulation concentration, and more preferably 1.5 times.

<Colorants>

The toner is obtained by salting out/fusing the composite resin particles and colored particles.

Listed as colorants which constitute the toner of the present invention may be inorganic pigments, organic pigments, and dyes.

Employed as said inorganic pigments may be those conventionally known in the art. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

Employed as said organic pigments and dyes may be those conventionally known in the art. Specific organic pigments as well as dyes are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

If desired, these organic pigments, as well as dyes, may be employed individually or in combination of selected ones. Further, the added amount of pigments is commonly between 2 and 20 percent by weight, and is preferably between 3 and 15 percent by weight.

Said colorants may also be employed while subjected to surface modification. As said surface modifying agents may be those conventionally known in the art, and specifically, preferably employed may be silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane.

Examples of the titanium coupling agent include those marketed with brand "Plainact" TTS, 9S, 38S, 41B, 46B, 55, 138S, 238S etc., by Ajinomoto Corporation, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include "Plainact AL-M".

These surface modifiers is added preferably in amount of 0.01 to 20% by weight, and more preferably 0.5 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

(Releasing Agents)

Toner employed in the invention comprises aggregation toner particles obtained by salting out/fusing composite resin particles containing a releasing agent in a region other than the outermost layer (i.e., core or inter layer) and colored particles.

A low molecular weight polypropylene having number average molecular weight of from 1,5000 to 9,000, or a low molecular weight polyethylene is preferably employed as a releasing agent. The most preferable one is an ester represented by the following formula.

$$R^1—(OCO—R^2)_n$$

In the Formula (1) n is an integer of 1 to 4, preferably 2 to 4, more preferably 3 or 4, in particular preferably 4. $R^1$ and $R^2$ each represent a hydrocarbon group which may have a substituent. Said hydrocarbon group $R^1$ generally has from 1 to 40 carbon atoms, preferably has from 1 to 20 carbon atoms, and more preferably has from 2 to 5 carbon atoms.

Said hydrocarbon group $R^2$ generally has from 1 to 40 carbon atoms, preferably has from 16 to 30 carbon atoms, and more preferably has from 18 to 26 carbon atoms.

Listed as specific examples of specified ester compounds may be those represented by formulas 1) through 22) shown below.

1)

$$CH_3—(CH_2)_{12}—COO—(CH_2)_{17}—CH_3$$

2)

$$CH_3—(CH_2)_{18}—COO—(CH_2)_{17}—CH_3$$

3)

$$CH_3—(CH_2)_{20}—COO—(CH_2)_{21}—CH_3$$

4)

$$CH_3—(CH_2)_{14}—COO—(CH_2)_{19}—CH_3$$

5)

$$CH_3—(CH_2)_{20}—COO—(CH_2)_6—O—CO—(CH_2)_{20}—CH_3$$

6)

$$CH_3—(CH_2)_{20}—COO—(CH_2)_2—\underset{}{\overset{CH_3}{\overset{|}{CH}}}—CH_2—O—CO—(CH_2)_{20}—CH_3$$

7)

$$CH_3—(CH_2)_{22}—COO—(CH_2)_2—\overset{CH_3}{\overset{|}{CH}}—CH_2—O—CO—(CH_2)_{22}—CH_3$$

8)

$$CH_3—(CH_2)_{22}—COO—CH_2—\underset{CH_3}{\overset{CH_3}{C}}—CH_2—O—CO—(CH_2)_{22}—CH_3$$

9)

-continued $$CH_3—(CH_2)_{26}—COO—CH_2—\underset{CH_3}{\overset{CH_3}{C}}—CH_2—O—CO—(CH_2)_{26}—CH_3$$

10)

$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

11)

$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

12)

$$\begin{array}{l} CH_2—OH \\ | \\ CH—O—CO—(CH_2)_{26}—CH_3 \\ | \\ CH_2—O—CO—(CH_2)_{26}—CH_3 \end{array}$$

13)

$$\begin{array}{l} CH_2—OH \\ | \\ CH—O—CO—(CH_2)_{22}—CH_3 \\ | \\ CH_2—O—CO—(CH_2)_{22}—CH_3 \end{array}$$

14)

$$\begin{array}{l} CH_2—OH \\ | \\ CH—OH \\ | \\ CH_2—O—CO—(CH_2)_{26}—CH_3 \end{array}$$

15)

$$\begin{array}{l} CH_2—OH \\ | \\ CH—OH \\ | \\ CH_2—O—CO—(CH_2)_{22}—CH_3 \end{array}$$

16)

$$CH_3—(CH_2)_{26}—COO—CH_2—\overset{CH_3}{\overset{|}{C}}—CH_2—O—CO—(CH_2)_{26}—CH_3$$
$$\underset{}{\overset{|}{CH_2}}—O—CO—(CH_2)_{26}—CH_3$$

17)

$$CH_3—(CH_2)_{20}—COO—CH_2—\overset{CH_2CH_3}{\overset{|}{C}}—CH_2—O—CO—(CH_2)_{20}—CH_3$$
$$\underset{}{\overset{|}{CH_2}}—O—CO—(CH_2)_{20}—CH_3$$

18)

$$CH_3—(CH_2)_{26}—COO—CH_2—\overset{CH_2—O—CO—(CH_2)_{26}—CH_3}{\overset{|}{C}}—CH_2—O—CO—(CH_2)_{26}—CH_3$$
$$\underset{}{\overset{|}{CH_2}}—O—CO—(CH_2)_{26}—CH_3$$

19)

$$CH_3—(CH_2)_{20}—COO—CH_2—\overset{CH_2—O—CO—(CH_2)_{20}—CH_3}{\overset{|}{C}}—CH_2—O—CO—(CH_2)_{20}—CH_3$$
$$\underset{}{\overset{|}{CH_2}}—O—CO—(CH_2)_{20}—CH_3$$

20)

-continued

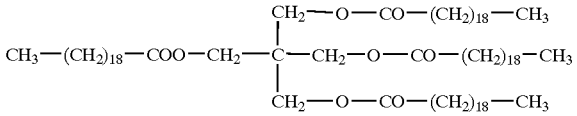

21)

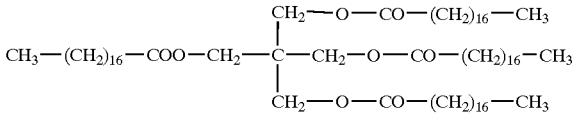

22)

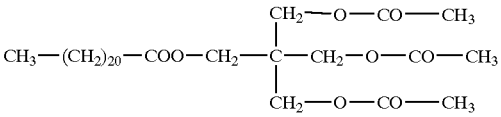

Preferable examples are those having a melting point of 50 to 130° C., and more preferably are those having a melting point of 60 to 120° C.

(Content Ratio of Releasing agents)

The content ratio of releasing agents in the toner is commonly 1 to 30 percent by weight, is preferably 2 to 20 percent by weight, and is more preferably 3 to 15 percent by weight.

Various charge control agent which can be dispersed in water is employed. Preferable example includes silica powder, titan powder, alumina powder and so on.

<External Additives>

For the purpose of improving fluidity as well as chargeability, and of enhancing cleaning properties, the toner of the present invention may be employed into which so-called external additives are incorporated. Said external additives are not particularly limited, and various types of fine inorganic particles, fine organic particles, and lubricants may be employed.

Employed as fine inorganic particles may be those conventionally known in the art. Specifically, it is possible to preferably employ fine silica, titanium, and alumina particles and the like. These fine inorganic particles are preferably hydrophobic.

Specifically listed as fine silica particles, for example, are commercially available R-805, R-976, R-974, R-972, R-812, and R-809, produced by Nippon Aerosil Co.; HVK-2150 and H-200, produced by Hoechst Co.; commercially available TS-720, TS-530, TS-610, H-5, and MS-5, produced by Cabot Corp;, and the like.

Listed as fine titanium particles, for example, are commercially available T-805 and T-604, produced by Nippon Aerosil Co.; commercially available MT-100S, MT-100B, MT-500BS, MT-600, MT-600SS, and KA-1, produced by Teika Co.; commercially available TA-300SI, TA-500, TAF-130, TAF-510, and TAF-510T, produced by Fuji Titan Co.; commercially available IT-S, IT-OA, IT-OB, and IT-OC, produced by Idemitsu Kosan Co.; and the like.

Listed as fine alumina particles, for example, are commercially available RFY-C and C-604, produced by Nippon Aerosil Co., commercially available TTO-55, produced by Ishihara Sangyo Co., and the like.

Further, employed as fine organic particles are fine spherical organic particles having a number average primary particle diameter of 10 to 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external agents is preferably 0.1 to 5 percent by weight with respect to the toner.

(Addition Process of External Additives)

This process is one in which external additives are added to dried toner particles.

Listed as devices which are employed for the addition of external additives, may be various types of mixing devices known in the art, such as tubular mixers, Henschel mixers, Nauter mixers, V-type mixers, and the like.

Number average diameter of the toner particle is preferably from 3 to 10 $\mu$m, more preferably from 3 to 8 $\mu$m. Particle diameter is controlled by adjusting concentration of coagulant (salting agent), amount of organic solvent, fusing time, composition of polymer during the toner preparation.

Number of fine toner particles having strong adhesion which fly to heating device and generate off-set is reduced, and high transfer performance is obtained whereby image quality of half tone, fine line, dot and so on is improved by employing the toner having average diameter of 3 to 10 $\mu$m. Particle diameter is controlled by adjusting concentration of coagulant (salting agent), amount of organic solvent, fusing time, composition of polymer during the toner preparation.

It is possible to determine said volume average particle diameter of toner particles, employing a Coulter Counter TA-II, a Coulter Multisizer, SLAD 1100 (a laser diffraction type particle diameter measuring apparatus, produced by Shimadzu Seisakusho), and the like.

Herein values are shown which are obtained based on the particle diameter distribution in the range of 2.0 to 40 $\mu$m, employing an aperture having an aperture diameter of 100 $\mu$m of said Coulter Counter TA-II as well as said Coulter Multisizer.

The shape coefficient of the toner particles is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane. The shape coefficient was determined in such a manner that toner particles were photographed under a magnification factor of 2,000, employing a scanning type electron microscope, and the resultant photographs were analyzed employing "Scanning Image Analyzer", manufactured by JEOL LTD. At that time, 100 toner particles were employed and the shape coefficient was obtained employing the aforementioned calculation formula.

Circle having a radius of L/10, which is positioned in toner particle, is rolled along the periphery of toner particle, while remaining in contact with the circumference at any point. When it is possible to roll any part of said circle without substantially crossing over the circumference of toner particle, a toner is designated as "a toner having no corners". The numbers of toner particles employed for measurement for this purpose is 100.

The toner of the present invention preferably has a sum M of at least 70 percent. Said sum M is obtained by adding relative frequency ml of toner particles, included in the most frequent class, to relative frequency m2 of toner particles included in the second frequent class in a histogram showing the particle diameter distribution, which is drawn in such a manner that natural logarithm lnD is used as an abscissa, wherein D (in $\mu$m) represents the particle diameter of a toner particle, while being divided into a plurality of classes at intervals of 0.23, and the number of particles is used as an ordinate.

By maintaining the sum M of the relative frequency ml and the relative frequency m2 at no less than 70 percent, the variance of the particle diameter distribution of toner particles narrows. As a result, by employing said toner in an image forming process, the minimization of generation of selective development may be secured.

In the present invention, the above-mentioned histogram showing the particle diameter distribution based on the number of particles is one in which natural logarithm lnD (wherein D represents the diameter of each particle) is divided at intervals of 0.23 into a plurality of classes (0 to 0.23, 0.23 to 0.46, 0.46 to 0.69, 0.69 to 0.92, 0.92 to 1.15, 1.15 to 1.38, 1.38 to 1.61, 1.61 to 1.84, 1,84 to 2.07, 2.07 to 2.30, 2.30 to 2.53, 2.53 to 2.76 . . . ), being based on the number of particles. Said histogram was prepared in such a manner that particle diameter data of a sample measured by a Coulter Multisizer according to conditions described below were transmitted to a computer via an I/O unit, so that in said computer, said histogram was prepared employing a particle diameter distribution analyzing program.

(Measurement Conditions)

Aperture: 100 $\mu$m

Sample preparation method: added to 50 to 100 ml of an electrolytic solution (ISOTON R-11, manufactured by Coulter Scientific Japan Co) is a suitable amount of a surface active agent (a neutral detergent) and stirred. Added to the resulting mixture is 10 to 20 mg of a sample to be measured. To prepare the sample, the resulting mixture is subjected to dispersion treatment for one minute employing an ultrasonic homogenizer.

<Developers>

The toner of the present invention may be employed in either a single-component developer or a two-component developer.

Listed as single-component developers are a non-magnetic single-component developer, and a magnetic single-component developer in which magnetic particles having a diameter of 0.1 to 0.5 $\mu$m are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 $\mu$m, and is more preferably 25 to 80 $\mu$m.

The volume average particle diameter of said carrier can be generally determined employing a laser diffraction type particle diameter distribution measurement apparatus "Helos", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

(Image Forming Method)

A cross-section of a color forming apparatus is shown in FIG. 1 as an example of the color forming apparatus for describing the image forming method according to the invention. In FIG. 1, 21 is a photoreceptor drum as a latent image carrier, which is constituted by coating OPC or organic photosensitive substance, on a substrate drum. The photoreceptor drum is grounded and driven so as to be clockwise rotated as is shown in the drawing. 22 is a scorotron charging device as a charging means by which gives a uniform charge of a high potential HV on the outer surface of the photoreceptor drum 21 by corona discharge from a corona discharge wire and a grid held at a grid potential of VG. It is preferable to remove the charge on the photoreceptor surface by exposing to light by PCL or a charge removing device before the charging using a light emission diode to erase the history of the photoreceptor until the last print in advance of the charging.

After the uniform charging on the photoreceptor drum 21, light exposure is applied imagewise by exposing means 23 according to the image information. By the exposing means 23, the course of light from a laser diode as the light source, not shown in the drawing, is changed by a rotating polygon mirror 131, a f$\theta$ lens 132, a sylindrical lens 133 and a reflecting mirror to perform the main scanning.

The imagewise exposure is synchronously performed with the sub-scanning or the rotation of the photoreceptor drum 21 to form a latent image. In this example, a reversal latent image is formed in which the character portion has a lower potential LV.

Developing means 24Y, 24M, 24C and 24K each contain two-component developers each containing a yellow Y, magenta M, cyan C and black toner, respectively, are arranged around the photoreceptor drum 21.

The image formation is performed as follows: first, for example, the development of yellow image is performed. The developer is usually comprises a carrier comprised of ferrite core particle coated with a insulating resin and a toner composed of polyester resin as the main composition and a pigment having a corresponding color, a charge controlling agent, silica and titanium oxide added to the main composition. The developer is formed into a layer regulated in a thickness of from 100 to 600 $\mu$m on a developing sleeve by a developer layer forming means.

The gap between the developing sleeve and the photoreceptor drum 21 in the developing region is set from 0.2 to 1.0 mm which is larger than the thickness of the developer layer, and VAC of AC bias and VDC of DC bias are applied in overlapping between the gap. Toner given an opportunity to release from the carrier is not adhered to the portion having a higher potential than the VAC and adhered to the portion of VL which is lower than the potential of the VDC since the polarity of VDC, VH and the potential of toner are the same. Thus the reversal development is occurred.

After the development of the first color, the image forming process of the second color, for example, magenta is started. The uniform charging by the scorotron charging device is carried out again and a latent image is formed by the exposing means 23 according to the image information of the second color.

Among the whole surface of the photoreceptor drum uniformly charged at the potential of VH, the latent image is formed in the same manner as in the first color formation at the portion at which no first color image is formed. However, at the portion at which the first color image is formed, a latent image having a potential of VM' by the influence of the light shading by the toner of the first color image and the potential of the toner itself, and the development is performed corresponding to the potential difference between the VDC and VM'. Consequently, the balance between the first and the second colors is lost at the portion at which the first color image and the second color image are overlapped when the first color image is formed by the latent image of VL. Therefore, the exposure amount of the first color image is reduced some times so that the potential is made to an intermediate potential MV satisfying the condition of VH>VM>VL.

The image formation is performed in the same manner as in the second color image regarding to the third color of cyan and the fourth color of black. Thus four color images are formed on the outer surface of the photoreceptor drum 21.

A sheet of recording medium P such as recording paper taken out from a paper supplying cassette through a half sylindrical roller is conveyed by the pair of taking-out rollers and once stopped near a pair of register rollers. The paper is supplied to the transferring zone by rotation of the register rollers synchronized with the timing of the image transfer.

In the transferring zone, a transferring means is contacted with pressure synchronously with the time of the transferring and the recording material P is inserted so that the multi-color image is transferred at once.

Then the charge on the recording material P is removed by a separating means and the recording material P is separated from the outer surface of the photoreceptor and conveyed to a fixing apparatus or fixing means 40. In the fixing means, the toner on the recording material P is melted and adhered to the recording material by heat and pressure by a heating roller or upper roller 41 and a pressure roller or lower roller 42 and the recording material is discharged onto an outlet tray arranged outside the apparatus through a outlet roller. The transferring means is released from the surface of the photoreceptor 21 after passing the recording material P to prepare the next image formation.

The photoreceptor 21 is discharged by a discharging device after releasing the recording material and the toner remained on the drum is removed and cleaned by a blade of a cleaning means 25 contacted to the drum surface with pressure. Thereafter, the photoreceptor drum is subjected to charge removing by the PCL and charging by the scorotron charging device, and is entered into the process for the formation next image. The foregoing blade is moved to be released from the surface of the photoreceptor 21 just after the cleaning of the photoreceptor surface. The waste toner scraped off and fallen into the cleaning means 25 by the blade is discharged by a screw and stored in a waste toner recovering container not shown in the drawing.

A contact heating method is suitably applied to the fixing method usable in the invention. Particularly, a press-contact fixing method is suitably usable, in which the fixing is carried out by a heating roll or a rotatable pressure member including a fixed heating member.

In the heating roller fixing method, the fixing device is constituted by an upper roller constituted by a cylinder of metal such as iron or aluminum and the surface thereof is usually covered with a polymer such as polytetrafluoroethylen or a copolymer of polytetrafluoroethylene/perfluoroalkoxyvinyl ether and a heat source is arranged at the interior thereof, and a lower roller formed by silicone rubber. As the heat source, one having a line-shaped heater is typically used, by which the surface of the upper roller is heated by a temperature of from 120 to 200° C. In the fixing portion, pressure is applied between the upper and the lower rollers so as to form a nip by deformation of the lower roller. The width of the nip is from 1 to 10 mm, preferably from 1.5 to 7 mm. The line-speed in the fixing treatment is preferably from 40 mm/sec to 600 mm/sec. When the nip width is too small, the heat cannot be uniformly applied so that unevenness of fixing is caused. Besides, when the nip width is too large, the melt of the toner is accelerated and off-set in the fixing process is excessively occurred.

A mechanism for cleaning the fixing device may be attached to the image forming apparatus. As the cleaning mechanism, methods such as a method by which silicone oil is supplied onto the upper roller or a film or a method by which the fixing device is cleaned by a pad, a roller or a web each immersed by silicone oil may be applied.

Examples of the silicone oil include polydimethylsiloxane, polymethylphenylsiloxane and polydiphenylsiloxane. Other than the above, a siloxane containing a fluorine atom is also suitably usable.

Figure 2:
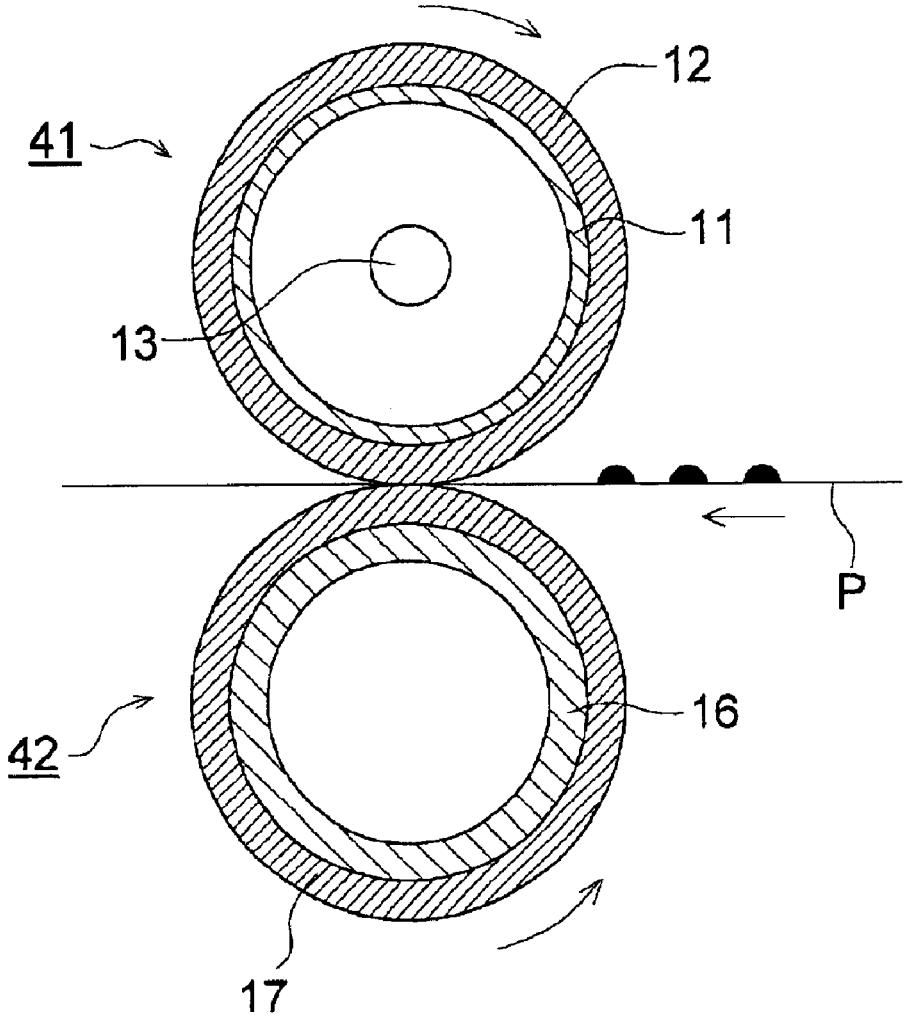
FIG. 2 shows a schematic view of fixing device employed in the image forming apparatus to which the color toner of the invention is applicable.

A concrete example of the heat-fixing device is shown in the schematic drawing of FIG. 2.

The fixing device has a heating roller or upper roller 41 and a pressure roller or lower roller 42. The upper roller is constituted by a aluminum alloy cylindrical pipe having an inner diameter of 40 mm, a whole length of 310 mm, a thickness of 1.0 mm and a layer of PFA, tetrafluoroethylene perfluoroalkylvinyl ether copolymer, with a thickness of 120 μm covering the outer surface of the roller. Inside of the upper roller, a heater 13 is arranged at the center portion thereof. The lower roller 42 is constituted an iron pipe having an inner diameter of 40 mm and a thickness of 2.0 mm and a sponge of silicone rubber layer 17 having an ASCAR C hardness of 48 and a thickness of 2 mm covering the outer surface of the pipe. The nip width is 5.8 mm and the line speed of the fixing is set at 250 mm/sec.

For cleaning the fixing device, a web cleaning method using a web immersed with silicone oil having a viscosity of 10 Pa·s at 20° C. is applied.

The fixing temperature is controlled according to the surface temperature of the upper roller and set at 175° C. The coating amount of the silicone oil is 0.6 mg/area of A4 size sheet.

EXAMPLES

The present inventing will now be detailed with reference to examples. The term "part(s)" denotes part(s) by weight.

Preparation of Latex

LATEX 1HML (1) Preparation of Core Particle (a First Stage Polymerization)

Placed into a 5,000 ml separable flask fitted with a stirring unit, a temperature sensor, a cooling pipe, and a nitrogen gas inlet was a surface active agent solution (water based medium) prepared by dissolving 7.08 g of an anionic surface active agent (sodium dodecylbenzenesulfonate: SDS) in 3,010 g of deionized water, and the interior temperature was raised to 80° C. under a nitrogen gas flow while stirring at 230 rpm.

Subsequently, a solution prepared by dissolving 9.2 g of a polymerization initiator (KPS) in 200 g of deionized water was added to the surface active agent solution and it was heated at 75° C., a monomer mixture solution consisting of 70.1 g of styrene, 19.9 g of n-butyl acrylate, and 10.9 g of methacrylic acid was added dropwise over 1 hour. The mixture underwent polymerization by stirring for 2 hours at 75° C. (a first stage polymerization). Thus latex (a dispersion comprised of higher molecular weight resin particles) was obtained. The resulting latex was designated as Latex (1H)

The Latex (1H) has a peak molecular weight at 138,000.

(2) Forming an Inter Layer

A monomer solution was prepared in such way that 72.0 g of Exemplified Compound 19) was added to monomer mixture solution consisting of 105.6 g of styrene, 30.0 g of n-butyl acrylate, 6.4 g of methacrylic acid, 5.6 g of n-octyl-3-mercaptopropionic acid ester and the mixture was heated to 80° C. to dissolve the monomers in a flask equipped with a stirrer.

Surfactant solution containing 1.60 of anionic surfactant SDS dissolved in 1200 ml of deionized water was heated to 80° C. To the surfactant solution 28 g (converted in solid content) the latex 1H, dispersion of core particles, was added, then the monomer solution containing the Exemplified Compound 19) was mixed and dispersed by means of a mechanical dispersion machine, "CLEARMIX" (produced by M Technique Ltd.) equipped with circulating pass, and a dispersion (emulsion) containing dispersion particles (oil droplet) having homogeneous particle diameter (284 nm) was prepared.

Subsequently, initiator solution containing 5.0 g of polymerization initiator (KPS) dissolved in 240 ml of deionized water, and 750 ml of deionized water were added to the dispersion (emulsion). Polymerization was conducted by stirring with heating at 80° C. for 3 hours, as the result, latex (dispersion of composite resin particles which are composed of resin particles having higher molecular weight polymer resin covered with an intermediate molecular weight polymer) was obtained (a second stage polymerization). The resulting latex was designated as Latex (1HM).

(3) Forming Outer Layer (Third Stage Polymerization)

Polymerization initiator solution containing 7.4 g of polymerization initiator KPS dissolved in 200 ml deionized water was added to the latex 1HM, then monomer mixture solution consisting of 300 g of styrene, 95 g of n-butylacrylate, 15.3 g of methacrylic acid, and 10.4 g of n-octyl-3-mercaptoprpionic ester was added dropwise over 1 hour at temperature of 80° C. The mixture underwent polymerization by stirring with heating for 2 hours (a third stage polymerization), it was cooled to 28° C. Thus Latex 1HML composed of core composed of higher molecular weight polymer resin, an inter layer composed of an intermediate molecular weight polymer resin and an outer layer composed of lower molecular weight polymer resin in which inter layer the Exemplified Compound 19) was incorporated was obtained.

The polymers composed of composite resin particles composing the latex 1HML have peaks at molecular weight of 138,000, 80,000 and 13,000, and weight average particular size of the composite resin particles was 122 nm. Latex 2HML Latex 2HML was prepared in the same manner as the preparation of 1HML except that 7.08 g of anionic surface active agent, sodium dodecylsulfonate (SDS) was employed in place of the surface active agent (101). Latex 2HML is a dispersion of composite resin particle having core part composed of high molecular weight resin, inter layer part composed of middle molecular weight resin and outer layer part composed of low molecular weight resin.

The polymers composed of composite resin particles composing the latex 2HML have peaks at molecular weight of 138,000, 80,000 and 12,000, and weight average particular size of the composite resin particles was 110 nm.

(Preparation Black Colored Particles 1Bk to 5Bk and 12Bk)

Added to 1600 ml of deionized water were 59.0 g of polyoxyethylene lauryl ether sodium sulfite (the numbers of adducts of ethyleneoxide 3), which were stirred and dissolved. While stirring the resulting solution, 420.0 g of carbon black, "Regal 330" (produced by Cabot Corp.), were gradually added, and subsequently dispersed employing a stirring unit, "Clearmix" (produced by M Technique Ltd.). Black Colorant Dispersion Bk was obtained Placed into a four-necked flask fitted with a temperature sensor, a cooling pipe, a nitrogen gas inlet unit, and a stirring unit were 420.7 g (converted in solid content) of Latex (1HML), 900 g of deionized water, and 160 g of Black Colorant Dispersion Bk, and the resulting mixture was stirred. After adjusting the interior temperature to 30° C., 5N aqueous sodium hydroxide solution was added to the resulting solution, and the pH was adjusted to 11.0.

Subsequently, an aqueous solution prepared by dissolving 12.1 g of magnesium chloride tetrahydrate in 1000 ml of deionized water was added at 30° C. over 6 minutes. After setting the resulting mixture aside for 3 minutes, it was heated so that the temperature was increased to 90° C. within 6 minutes (at a temperature increase rate of 10° C./minute). While maintaining the resulting state, the diameter of coalesced particles was measured employing a "Coulter Counter TA-II". When the volume average particle diameter reached 5.5 $\mu$m, the growth of particles was terminated by the addition of an aqueous solution prepared by dissolving 80.4 g of sodium chloride in 1000 ml of deionized water, and further fusion was continually carried out at a liquid media temperature of 85±2° C. for 2 hours, while being heated and stirred (digestion process).

Thereafter, the temperature was decreased to 30° C. at a rate of 8° C./minute. Subsequently, the pH was adjusted to 2.0, and stirring was terminated. The resulting coalesced particles were collected through filtration through a glass filter, and washed with deionized water. Washed particles were then dried by flush jet dryer with inlet air temperature at 60° C., and dried by fluidized-bed layer dryer at 60° C., thus colored particles containing the releasing agent, Exemplified Compound 19.

The obtained colored particles were subjected repeatedly to dispersing in 5,000 ml water, filtering and separation so that the black colored particles 1BK to 5BK and 12Bk were obtained, each having characteristics such as shape, particle size distribution re-dispersion electro-conductivity and re-dispersion absorbance shown in Tables 1 through 4.

(Preparation of Black Colored Particles 6Bk to 10Bk)

Black colored particles 6Bk to 10Bk were prepared in the same way as the black colorant particles 1Bk to 5Bk, except that 420.7 g (converted in solid content) of latex 2HML was employed in place of latex 1HML and stirring condition and heating condition in the monitoring during salting/coagulation process were varied, so that the colored particles 6BK to 10BK were obtained, each having characteristics such as shape, particle size distribution re-dispersion electro-conductivity and re-dispersion absorbance shown in Tables 1 through 4.

Preparation of Black Colored Particles 11Bk (Example of Suspension Polymerization Method)

A mixture consisting of 165 g of styrene, 35 g of n-butyl acrylate, 10 g of carbon black, 2 g of di-t-butylsalicylic acid metal compound, 8 g of a styrene-methacrylic acid copolymer, and 20 g of paraffin wax (having an mp of 70° C.) was heated to 60° C., and uniformly dissolve-dispersed at 12,000 rpm employing a TK Homomixer (Tokushuki Kako Kogyo Co.).

Added to the resulting dispersion were 10 g of 2,2'-azobis (2,4-valeronitile) as the polymerization initiator and dissolved to prepare a polymerizable monomer composition.

Subsequently, 450 g of 0.1 M sodium phosphate were added to 710 g of deionized water, and 68 g of 1.0 M calcium chloride were gradually added while stirring at 13,000 rpm, employing a TK Homomixer, whereby a dispersion in which tricalcium phosphate was prepared. Said polymerizable monomer composition was added to said dispersion and stirred at 10,000 rpm for 20 minutes employing a TK Homomixer, whereby said polymerizable monomer composition was granulated. Thereafter, the resulting composition underwent reaction at a temperature of from 75 to 95° C. for a period of from 5 to 15 hours, employing a reaction apparatus (having a crossed axes angle α of 45 degrees) in which two-step stirring blades were constituted. Tricalcium phosphate was dissolved employing hydrochloric acid and then removed. Subsequently, while employing a centrifuge, classification was carried out in a liquid medium utilizing a centrifugal sedimentation method. Thereafter, filtration, washing and drying were four times repeatedly carried out and thereby colored particles 11Bk having characteristics such as shape, particle size distribution re-dispersion electro-conductivity and re-dispersion absorbance shown in Tables 1 through 4.

(Preparation Yellow Colored Particles 1Y to 5Y and 12Y)

Added to 1600 ml of deionized water were 90.0 g of polyoxyethylene lauryl ether sodium sulfite (the numbers of adducts of ethyleneoxide 3), which were stirred and dissolved. While stirring the resulting solution, 420 g of yellow dye (C.I. Solvent Yellow 93), were gradually added, and subsequently dispersed employing a stirring unit, "Clearmix" (produced by M Technique Ltd.). The dispersion of yellow dye (Y) was obtained. Average weight particle diameter was 250 nm, measured by employing an electrophoresis light scattering photometer "ELS-800" (produced by Ohtsuka Denshi Co.).

The yellow colored particles 1Y to 5Y and 12Y were obtained in the same way as black colored particles 1Bk to 5Bk and 12Bk except that yellow dye dispersion (Y) was employed in place of black colorant dispersion Bk, each having characteristics such as shape, particle size distribution re-dispersion electro-conductivity and re-dispersion absorbance shown in Tables 1 through 4.

(Preparation Yellow Colored Particles 6Y to 10Y)

Yellow colored particles 6Y to 10Y were prepared in the same way as the yellow colored particles 1Y to 5Y, except that 420.7 g of latex 2HML was employed in place of latex 1HML and stirring condition and heating condition in the monitoring during salting/coagulation process were varied, so that the yellow colored particles 6Y to 10Y were obtained, each having characteristics such as shape, particle size distribution re-dispersion electro-conductivity and re-dispersion absorbance shown in Tables 1 through 4.

Preparation of Yellow Colored Particles 11Y

Yellow colored particles 11Y was obtained in the same way as black colored particles 11bk, except that C.I. Solvent Yellow 93 was employed in place of carbon black. The yellow colored particles 11Y has characteristics such as shape, particle size distribution re-dispersion electro-conductivity and re-dispersion absorbance shown in Tables 1 through 4.

(Preparation Magenta Colored Particles 1M to 5M and 12M)

Added to 1600 ml of deionized water were 90.0 g of polyoxyethylene lauryl ether sodium sulfite (the numbers of adducts of ethyleneoxide 3), which were stirred and dissolved. While stirring the resulting solution, 263 g of magenta pigment (C.I. Pigment Red 122), were gradually added, and subsequently dispersed employing a stirring unit, "Clearmix" (produced by M Technique Ltd.). The dispersion of magenta pigment (M) was obtained. Average weight particle diameter was 221 nm, measured by employing an electrophoresis light scattering photometer "ELS-800" (produced by Ohtsuka Denshi Co.).

The magenta colored particles 1M to 5M and 12M were obtained in the same way as black colored particles 1Bk to 5Bk and 12Bk except that magenta pigment dispersion (M) was employed in place of black colored dispersion Bk, each having characteristics such as shape, particle size distribution re-dispersion electro-conductivity and re-dispersion absorbance shown in Tables 1 through 4.

(Preparation Magenta Colored Particles 6M to 10M)

Magenta colored particles 6M to 10M were prepared in the same way as the magenta colored particles 1M to 5M, except that 420.7 g of latex 2HML was employed in place of latex 1HML and stirring condition and heating condition in the monitoring during salting/coagulation process were varied, so that the magenta colored particles 6M to 10M were obtained, each having characteristics such as shape, particle size distribution re-dispersion electro-conductivity and re-dispersion absorbance shown in Tables 1 through 4.

Preparation of Magenta Colored Particles 11M Magenta particles 11M was obtained in the same way as black colored particles 11Bk, except that C.I. Pigment Red 122 was employed in place of carbon black. The particles 11M has characteristics such as shape, particle size distribution re-dispersion electro-conductivity and re-dispersion absorbance shown in Tables 1 through 4.

(Preparation Cyan Colored Particles 1C to 5C and 12C)

Added to 1600 ml of deionized water were 90.0 g of polyoxyethylene lauryl ether sodium sulfite (the numbers of adducts of ethyleneoxide 3), which were stirred and dissolved. While stirring the resulting solution, 263 g of cyan pigment (C.I. Pigment Blue 15:3), were gradually added, and subsequently dispersed employing a stirring unit, "Clearmix" (produced by M Technique Ltd.). The dispersion of cyan pigment (C) was obtained. Average weight particle diameter was 221 nm, measured by employing an electrophoresis light scattering photometer "ELS-800" (produced by Ohtsuka Denshi Co.).

The cyan colored particles 1C to 5C and 12C were obtained in the same way as black colored particles 1Bk to 5Bk and 12Bk except that magenta pigment dispersion (C) was employed in place of black colorant dispersion Bk, each having characteristics such as shape, particle size distribution re-dispersion electro-conductivity and re-dispersion absorbance shown in Tables 1 through 4.

(Preparation Cyan Colored Particles Examples 6C to 10C)

Cyan colored particles 6C to 10C were prepared in the same way as the cyan colored particles 1C to 5C, except that 420.7 g of latex 2HML was employed in place of latex 1HML and stirring condition and heating condition in the monitoring during salting/coagulation process were varied, so that the colored particles 6M to 10M were obtained, each having characteristics such as shape, particle size distribution re-dispersion electro-conductivity and re-dispersion absorbance shown in Tables 1 through 4.

Preparation of Cyan Colored Particles 11C

Cyan colored particles 11C was obtained in the same way as black colored particles 11Bk, except that pigment (C.I. Pigment Blue 15:3), was employed in place of carbon black. The particles 11 M has characteristics such as shape, particle size distribution re-dispersion electro-conductivity and re-dispersion absorbance shown in Tables 1 through 4.

Added to the colored particles were 1.0% by weight of hydrophobic silica particles (number average primary particle size of 10 nm, hydrophobicity of 63) as well as 0.8% by weight of hydrophobic titanium oxide particles (number average primary particle size of 25 nm, hydrophobicity of 60, and the resulting composition was stirred employing a Henschel mixer, whereby a negatively chargeable toner was obtained.

The shape and particle diameter of the colored particles do not change by the addition of the hydrophobic silica or the hydrophobic titanium oxide particles.

The number of free colorant particles, re-dispersion electro-conductivity, light absorbance and so on are shown in Tables 3 and 4.

TABLE 1

| Toner | Colored particles | Ratio of toner particles having shape coefficient of 1.2 to 1.6 | Variation coefficient of shape coefficient | Ratio of particles having no corner | Number average particle diameter | Variation coefficient of number distribution | M (sum of m1 and m2) |
|---|---|---|---|---|---|---|---|
| 1Bk | 1Bk | 61.6 | 15.7 | 58 | 5.7 | 24.8 | 78.1 |
| 2Bk | 2Bk | 61.6 | 15.7 | 58 | 5.7 | 24.8 | 78.1 |
| 3Bk | 3Bk | 61.6 | 15.7 | 58 | 5.7 | 24.8 | 78.1 |
| 4Bk | 4Bk | 61.6 | 15.7 | 58 | 5.7 | 24.8 | 78.1 |
| 5Bk | 5Bk | 61.6 | 15.7 | 58 | 5.7 | 24.8 | 78.1 |
| 6Bk | 6Bk | 66.2 | 15.1 | 54 | 5.9 | 25.2 | 67.1 |
| 7Bk | 7Bk | 67.9 | 15.4 | 48 | 5.8 | 26.4 | 65.2 |
| 8Bk | 8Bk | 68.2 | 14.9 | 47 | 5.5 | 28.9 | 67.5 |
| 9Bk | 9Bk | 65.7 | 15.1 | 46 | 5.8 | 25.4 | 61.2 |
| 10Bk | 10Bk | 61.6 | 15.7 | 45 | 5.8 | 26.1 | 58.8 |
| 11Bk | 11Bk | 40.2 | 17.2 | 86 | 5.7 | 26.5 | 67.5 |
| 12Bk | 12Bk | 61.6 | 15.7 | 58 | 5.7 | 24.8 | 78.1 |
| 1Y | 1Y | 68.6 | 14.9 | 77 | 5.7 | 25.9 | 72.1 |
| 2Y | 2Y | 68.6 | 14.9 | 77 | 5.7 | 25.9 | 72.1 |
| 3Y | 3Y | 68.6 | 14.9 | 77 | 5.7 | 25.9 | 72.1 |
| 4Y | 4Y | 68.6 | 14.9 | 77 | 5.7 | 25.9 | 72.1 |
| 5Y | 5Y | 68.6 | 14.9 | 77 | 5.7 | 25.9 | 72.1 |
| 6Y | 6Y | 66.2 | 15.1 | 54 | 5.9 | 25.2 | 67.1 |
| 7Y | 7Y | 65.1 | 15.8 | 47 | 5.5 | 26.2 | 64.2 |
| 8Y | 8Y | 68.1 | 14.9 | 47 | 5.5 | 28.9 | 64.2 |
| 9Y | 9Y | 65.7 | 15.1 | 46 | 5.8 | 25.4 | 61.2 |
| 10Y | 10Y | 61.6 | 15.7 | 45 | 5.8 | 26.1 | 58.8 |
| 11Y | 11Y | 42.5 | 17.2 | 87 | 5.7 | 26.5 | 67.5 |
| 12Y | 12Y | 65.6 | 15.6 | 74 | 5.7 | 25.1 | 70.5 |

TABLE 2

| Toner | Colored particles | Ratio of toner particles having shape coefficient of 1.2 to 1.6 | Variation coefficient of shape coefficient | Ratio of particles having no corner | Number average particle diameter | Variation coefficient of number distribution | M (sum of m1 and m2) |
|---|---|---|---|---|---|---|---|
| 1M | 1M | 65.6 | 15.6 | 74 | 5.7 | 25.1 | 70.5 |
| 2M | 2M | 65.6 | 15.6 | 74 | 5.7 | 25.1 | 70.5 |
| 3M | 3M | 65.6 | 15.6 | 74 | 5.7 | 25.1 | 70.5 |
| 4M | 4M | 65.6 | 15.6 | 74 | 5.7 | 25.1 | 70.5 |
| 5M | 5M | 65.6 | 15.6 | 74 | 5.7 | 25.1 | 70.5 |
| 6M | 6M | 66.2 | 15.1 | 54 | 5.9 | 25.2 | 67.1 |
| 7M | 7M | 65.1 | 15.4 | 47 | 5.5 | 26.2 | 64.5 |
| 8M | 8M | 68.1 | 14.9 | 48 | 5.5 | 28.5 | 62.1 |
| 9M | 9M | 65.7 | 15.1 | 45 | 5.8 | 25.2 | 61.2 |
| 10M | 10M | 61.6 | 15.7 | 46 | 5.8 | 26.1 | 58.8 |
| 11M | 11M | 41.1 | 17.2 | 86 | 5.7 | 26.5 | 67.5 |
| 12M | 12M | 65.6 | 15.6 | 74 | 5.7 | 25.9 | 70.5 |
| 1C | 1C | 66.1 | 15.4 | 71 | 5.7 | 25.9 | 71.2 |
| 2C | 2C | 66.1 | 15.4 | 71 | 5.7 | 25.9 | 71.2 |
| 3C | 3C | 66.1 | 15.4 | 71 | 5.7 | 25.9 | 71.2 |
| 4C | 4C | 66.1 | 15.4 | 71 | 5.7 | 25.9 | 71.2 |
| 5C | 5C | 66.1 | 15.4 | 71 | 5.7 | 25.9 | 71.2 |
| 6C | 6C | 66.1 | 15.1 | 54 | 5.9 | 25.2 | 67.1 |
| 7C | 7C | 56.8 | 15.8 | 47 | 5.5 | 26.2 | 64.2 |
| 8C | 8C | 68.1 | 14.9 | 47 | 5.5 | 28.9 | 64.2 |
| 9C | 9C | 65.3 | 15.1 | 48 | 5.8 | 25.4 | 61.2 |
| 10C | 10C | 59.4 | 15.3 | 45 | 5.8 | 26.1 | 58.8 |
| 11C | 11C | 40.9 | 17.1 | 88 | 5.7 | 26.5 | 67.5 |
| 12C | 12C | 66.1 | 15.4 | 71 | 5.7 | 25.9 | 71.2 |

TABLE 3

| | Black Toner | | | | Yellow Toner | | |
|---|---|---|---|---|---|---|---|
| | Toner | re-dispersion electro-conductivity ρbk (μs/cm) | The number of free colorant particles | Light absorbance at 500 nm | Toner | re-dispersion electro-conductivity ρy (μs/cm) | ρy - ρbk (μs/cm) |
| Example 1 | 1Bk | 2.6 | 1 | 0.008 | 1Y | 12.4 | 10.3 |
| Example 2 | 2Bk | 9.1 | 0 | 0.004 | 2Y | 10.2 | 1.1 |
| Example 3 | 3Bk | 8.4 | 6 | 0.076 | 3Y | 19.5 | 11.1 |
| Example 4 | 4Bk | 4.1 | 1 | 0.085 | 4Y | 8.5 | 4.4 |
| Example 5 | 5Bk | 9.1 | 7 | 0.009 | 5Y | 9.9 | 0.8 |
| Example 6 | 6Bk | 3.8 | 2 | 0.009 | 6Y | 11.1 | 7.3 |
| Example 7 | 7Bk | 2.8 | 3 | 0.008 | 7Y | 10.9 | 8.1 |
| Example 8 | 8Bk | 2.9 | 2 | 0.007 | 8Y | 12.5 | 9.6 |
| Example 9 | 9Bk | 3.1 | 2 | 0.008 | 9Y | 11.5 | 8.4 |
| Example 10 | 10Bk | 2.7 | 1 | 0.006 | 10Y | 12.6 | 9.9 |
| Example 11 | 11Bk | 2.5 | 2 | 0.007 | 11Y | 3.8 | 1.3 |
| Comparative example 1 | 12Bk | 26.6 | 10 | 0.095 | 3Y | 26.5 | −0.1 |
| Comparative example 2 | 1Bk | 2.6 | 1 | 0.008 | 3Y | 26.5 | 23.9 |
| Comparative example 3 | 12Bk | 26.6 | 10 | 0.095 | 12Y | 45.1 | 18.5 |

TABLE 4

| | Magenta Toner | | | Cyan Toner | | | |
|---|---|---|---|---|---|---|---|
| | Toner | re-dispersion electro-conductivity ρm (μs/cm) | ρm - ρbk (μs/cm) | Toner | re-dispersion electro-conductivity ρc (μs/cm) | ρc - ρbk (μs/cm) | ρ (max) - ρ (min) (μs/cm) |
| Example 1 | 1M | 12.3 | 9.7 | 1C | 11.1 | 8.5 | 9.8 |
| Example 2 | 2M | 10.1 | 1.0 | 2C | 11.1 | 2.0 | 2.0 |
| Example 3 | 3M | 18.9 | 10.5 | 3C | 20.4 | 12.0 | 12.0 |
| Example 4 | 4M | 8.8 | 4.6 | 4C | 8.4 | 4.3 | 4.3 |
| Example 5 | 5M | 10.1 | 1.0 | 5C | 10.1 | 1.3 | 0.8 |
| Example 6 | 6M | 11.8 | 8.0 | 6C | 11.5 | 7.7 | 8.0 |
| Example 7 | 7M | 12.2 | 9.4 | 7C | 12.4 | 9.6 | 9.6 |
| Example 8 | 8M | 12.9 | 10 | 8C | 11.5 | 8.6 | 10.0 |
| Example 9 | 9M | 11.8 | 8.7 | 9C | 12.2 | 9.1 | 9.1 |
| Example 10 | 10M | 11.6 | 8.9 | 10C | 11.8 | 9.1 | 9.9 |
| Example 11 | 11M | 3.9 | 1.4 | 11C | 4.1 | 1.6 | 1.6 |
| Comparative example 1 | 3M | 26.9 | 0.3 | 3C | 26.4 | −0.2 | 0.7 |
| Comparative example 2 | 3M | 26.9 | 24.3 | 3C | 26.4 | 23.8 | 24.6 |
| Comparative example 3 | 12M | 48.7 | 22.1 | 12C | 49.2 | 22.6 | 22.6 |

Preparation of Developers

A developer having a toner content of 9% by weight was prepared by mixing a toner comprising colored particles, hydrophobic silica and hydrophobic titanium oxide and a carrier comprising silicone coated carrier particles having a volume average particle size of 30 μm. Thus developer of each color was respectively prepared.

Evaluation Items

Practical image forming tests to form a full color image having pixel ratios of Y/M/C/Bk of each 15% were performed using the apparatus shown in FIGS. 1 and 2. The tests were carried out under a low temperature and low humidity condition of a temperature of 10° C. and a relative humidity of 20%, and a high temperature and high humidity condition of a temperature of 33° C. and a humidity of 80%. Thus obtained images were evaluated with respect to the density of a 10% dot image, the line width, the character clogging, the fine dot scattering, the color difference and the fogging. Results of the evaluation are shown in Table 5.

Methods of Measurement and Evaluation (1) Density of 10% Dot Image

The relative reflective density of a 10% dot image having an area of 20 mm×20 mm was measured by a reflective densitometer Macbeth RD-918. The reflective density of the white background of the image was used as the reference of the relative reflective density. The of the 10% dot image density was measured for evaluating the reproducibility of dot and that of the halftone image. When the density variation is less than 0.10, the variation of the image quality is a small and it may be concluded that there is no problem.

(2) Line Width

The width of line image corresponding to a two dot line signal was measured by a character evaluation system RT2000 manufactured by Yaman Co., Ltd. When the line width of the firstly printed image and that of the $20{,}000^{th}$ printed image are not more than 200 μm and the variation of the line width is less than 10 μm, there is no problem on the reproducibility of the fine line.

(3) Character Clogging

Images of 3-point and 5-point characters were formed and evaluated according to the following norms.

A: Both of the images of the 3-point and-5 point characters are clear and legible.

B: A part of the images of the 3-point characters were illegible but the images of the 5-point characters are clear and legible.

C: Almost images of the 3-point characters are illegible and all of apart of the images of the 5-point characters were illegible.

(4) Scattering of Fine Dot

A uniform 10% dot image of secondary colors, red, blue and green, and the scattering around the dots were observed by a magnifying glass and evaluated according to the following norms.

A: The scattering is almost not observed.

B: The scattering is observed a little but cannot be detected without careful observation.

C: The scattering is easily observed.

(5) Color Difference

The colors of solid images of the secondary colors, red, blue and green, formed on the first and $_{20000}$th prints were measured by Macbeth Color-Eye 7000. The color difference was calculated by CMC (2:1) color difference equation.

When the color difference determined by the CMC (2:1) color difference equation is less than 5, the variation of the color of the formed image is acceptable.

The secondary color formed by the color toners was evaluated with respect to the combination of the toners shown in Table 3.

(6) Occurrence of Fogging

The printing of a full color image having a pixel ratio of Y/M/C/Bk of each 15% was performed continuously for 1,000 times under a condition of high temperature of 33° C. and a high humidity of a relative humidity of 80%, and then the switch was off to rest the apparatus for 2 hours. The printing according to such the mode was repeated for 100 times until 100,000 sheets in total of prints were obtained. Thus obtained prints were successively observed and the number of prints until occurrence of the contamination of the image or fogging was counted.

A: No contamination is occurred until the 100,000th print.

B: No contamination is occurred until the 50,000th print.

C: The contamination is occurred before the 50,000th print.

D: The contamination is occurred before the 20,000th print.

TABLE 5

| | 10% dot density | | Line width (μm) | | Character clogging | | Fine dot scattering | | Color difference | | Fogging | |
|---|---|---|---|---|---|---|---|---|---|---|---|---|
| | L. T. L. H. | H. T. H. H. | L. T. L. H. | H. T. H. H. | L. T. L. H. | H. T. H. H. | L. T. L. H. | H. T. H. H. | L. T. L. H. | H. T. H. H. | L. T. L. H. | H. T. H. H. |
| Example 1 | 0.11 | 0.12 | 190 | 191 | A | A | A | A | A | A | A | A |
| Example 2 | 0.1 | 0.11 | 190 | 191 | A | A | A | A | A | A | A | A |
| Example 3 | 0.11 | 0.12 | 191 | 192 | A | B | A | B | A | A | A | B |
| Example 4 | 0.09 | 0.12 | 191 | 193 | A | A | A | A | A | A | A | A |
| Example 5 | 0.09 | 0.12 | 190 | 193 | A | A | A | B | A | A | A | A |
| Example 6 | 0.11 | 0.13 | 191 | 192 | A | A | A | A | A | A | A | A |
| Example 7 | 0.12 | 0.15 | 190 | 193 | A | A | A | B | A | A | A | A |
| Example 8 | 0.14 | 0.17 | 191 | 195 | A | B | A | B | A | B | A | A |
| Example 9 | 0.15 | 0.18 | 192 | 196 | A | B | A | B | A | B | A | B |
| Example 10 | 0.12 | 0.16 | 191 | 194 | B | B | B | B | B | B | A | B |
| Example 11 | 0.12 | 0.17 | 195 | 198 | A | B | B | B | B | B | A | B |
| Comparative example 1 | 0.14 | 0.22 | 187 | 211 | C | C | C | C | B | C | B | C |
| Comparative example 2 | 0.15 | 0.21 | 187 | 211 | B | C | C | C | C | C | B | C |
| Comparative example 3 | 0.12 | 0.28 | 186 | 222 | C | C | C | C | B | C | B | C |

In the Table 5, H. T., H. H., L. T. and L. H. denote "high temperature", "high humidity", "low temperature" and "low humidity", respectively.

It is displayed in the above table that there is no problem in Examples 1 to 11 within the invention. Besides, Comparative examples 1 to 3 without the invention have at least one problems among the properties thereof.

What is claimed is:

1. A set of toners for developing static latent image to form a color image by combining chromatic toners comprising a yellow toner, a magenta toner and a cyan toner, and a black toner, wherein each of the toners is a toner produced by polymerization of a polymerizable monomer in an aqueous medium, the difference of re-dispersion electro-conductivity of each of the chromatic toners and the black toner is within the range of from 0.8 to 12 μs/cm, the number of free colorant particles on the black toner surface is less than 9 per 500 toner particles, and a light absorbance at 500 nm of a black toner dispersion is not more than 0.08.

2. The set of toners of claim 1, wherein ρy> ρbk, ρm>ρbk and ρc>ρbk, when the ρy is re-dispersion electro-conductivity of the yellow toner, the ρm is a re-dispersion electro-conductivity of the magenta toner, the ρc is a re-dispersion electro-conductivity of the cyan toner and the ρbk is re-dispersion electro-conductivity of the black toner.

3. The set of toners of claim 1, wherein each of the toners is a toner produced by a process comprising:

polymerizing a polymerizable monomer in an aqueous medium, simultaneously salting out, aggregating and fusing, and washing.

4. The set of toners of claim 1, wherein each of the chromatic toners has an average diameter from 3 to 8 $\mu$m and a ratio of toner particles having a shape coefficient of from 1.2 to 1.6 of not less than 65%.

5. The set of toners of claim 1, wherein the sum M of a relative frequency m1 of toner particles included in the highest frequency class and a relative frequency of m2 toner particles included in the next frequency class is not less than 70% in a histogram showing the particle size distribution based on the number of the particles in which natural logarithm lnD of the particle diameter of each of the toners D $\mu$m is taken on the horizontal axis and the axis is divided every 0.23.

* * * * *